US005126105A

United States Patent [19]

Runkle et al.

[11] Patent Number: 5,126,105

[45] Date of Patent: Jun. 30, 1992

[54] WARHEAD BODY HAVING INTERNAL CAVITIES FOR INCORPORATION OF ARMAMENT

[75] Inventors: Joseph C. Runkle, Manchester-By-The-Sea; Timothy D. Howard, Georgetown, both of Mass.

[73] Assignee: Industrial Materials Technology, Inc., Andover, Mass.

[21] Appl. No.: 699,852

[22] Filed: May 14, 1991

Related U.S. Application Data

[63] Continuation of Ser. No. 697,120, May 8, 1991.

[51] Int. Cl.[5] ..... B22F 3/12; B22F 5/00

[52] U.S. Cl. ..... 419/30; 419/38; 419/42; 419/44

[58] Field of Search ..... 419/30, 42, 38, 68, 419/44

[56] References Cited

U.S. PATENT DOCUMENTS 3,383,208 5/1968 Corral ..... 419/42 X 4,861,546 8/1989 Friedman ..... 419/8

OTHER PUBLICATIONS

Hanson et al., "Titanium Near Net Shapes From Elemental Powder Blends", The Int. J. of Powder Metallurgy, vol. 26, No. 2.

*Primary Examiner*—Brooks H. Hunt
*Assistant Examiner*—Daniel J. Jenkins
*Attorney, Agent, or Firm*—Lahive & Cockfield

[57] ABSTRACT

Method and apparatus for forming an improved missile warhead comprising a cap section, a center section, and a mounting section, the three sections forming a tubular body closed by the cap section at one end thereof, with a plurality of cavities formed on the inner circumference of the center section. In formation of the cavity-bearing missile body, a missile body preform is isostatically formed from powder material along with low-density inclusions, the latter being removed during later processing to form an array of cavities, relying upon differential material densification for release of the inclusions from the pressed preform.

18 Claims, 2 Drawing Sheets

WARHEAD BODY HAVING INTERNAL CAVITIES FOR INCORPORATION OF ARMAMENT

This application is a continuation of co-pending application Ser. No. 07/697,120, filed May 8, 1991, entitled WARHEAD INCORPORATING HIGH DENSITY PARTICLES.

BACKGROUND OF THE INVENTION

The present invention relates to forming of warheads by isostatic compaction, and more particularly to forming complex patterns on the inside diameter of isostatically compacted warheads.

Cold isostatic pressing is one process of choice for forming components from particulate materials. In cold isostatic pressing, a powder charge is loaded into an elastomeric mold (called a "bag"). The bag is sealed after filling, positioned within the containment vessel, and exposed to a pressurized fluid environment.

The bag may be part of the pressure vessel (dry bag process) or may be a separate, independent unit placed within the pressure vessel (wet bag process). In either case, a mandrel may be included within the bag to aid in forming details on the resulting pressed material.

In operation, the fluid is pressurized and in turn applies a hydrostatic pressure to the bag. The bag thus acts as a hermetically sealed pressure transfer membrane between the fluid environment and the loaded material charge. If a mandrel is included inside the bag, then the pressure compacts the powder against the mandrel. Upon completion of the pressing process, the vessel and bag are opened and the pressed part (called a "preform") is separated from the mandrel. The preform is then thermally treated, sintered, to increase strength through diffusion bonding, and may also be hot isostatically pressed to final density.

However, removal of the mandrel from the preform may present special difficulty when parts of unusual, complex, or tapered interior are formed by such processing. For this reason, complex patterns are usually machined rather than pressed onto the interior of those parts requiring such patterns.

In the abovementioned application Ser. No. 07,697,120, incorporated herein by reference, a method and apparatus for making an improved missile warhead are disclosed wherein high density particulate materials are incorporated into a compacted-powder warhead body during its formation. The high density inclusions are preferably compatible with the material of the warhead body, and are preferably incorporated in an ordered array into the ID of the finished warhead by any of several disclosed. methods. A missile having a warhead incorporating such invention preferably has a proximity detonation capability whereby the included high density particles can act as armor-piercing projectiles on the order of the size and weight of the high density material inclusions. As a result, targets can be severely damaged without direct hits, thus increasing the lethality of such weapons. The above warheads are typically pressed from titanium powder.

It is therefore an object of the present invention to provide a warhead formed by cold isostatic processing and having improved lethality.

It is another object of the present invention to provide a warhead body which can accommodate material inclusions.

SUMMARY OF THE INVENTION

The present invention provides an improved missile warhead body having an ordered array of small cavities formed on the ID thereof. These cavities can accommodate post-compaction incorporation of material inclusions, such as high-density particles, explosive pellets, or a bullet-like pellet-particle combination, along the interior wall of the finished warhead body. After the warhead is detonated such high-density particles provide improved shrapnel effect and such explosive pellets provide a strong secondary detonation, either and both providing the warhead with increased lethality.

In one embodiment of the invention, an improved Stinger warhead is formed having an array of cavities in an ordered array on the warhead body ID. During manufacture, an ordered array of pre-compacted and pre-fired ceramic particles is formed within the warhead body preform during cold isostatic compaction. This pre-compaction brings material density of the ceramic to about 50 percent, and the pre-firing (to about 1000 degrees centigrade) promotes diffusion bonding for greater green strength (i.e., greater durability during handling). The preferable ceramic material composition comprises a mixture of one or more of the following: zirconia, alumina and/or ytria, for example, with a binder. Preferably the preform is formed from a titanium alloy. In a later step, these ceramic particles undergo a greater percentage volume reduction than the warhead body preform, and therefore fall out of the preform leaving the ordered array of cavities on the preform ID. These cavities are loaded with lethality-increasing armament, such as high-density particles and/or explosive pellets. When the warhead is detonated, such high-density particles provide improved shrapnel effect and such explosive pellets provide a strong secondary detonation, either and both providing the warhead with increased lethality.

In one method of the invention, a cavity array is formed on the interior of a warhead preform by employing a differential material compaction technique in which particles of a first density (e.g., a ceramic at about 50 percent of theoretical density) are compacted into the ID of a warhead preform, wherein the preform is compacted to a second density (e.g., titanium powder at 75 percent of theoretical density) but without further compacting the particles. Upon sintering, the preform densifies to about 95 percent density and the particles densify to about 90 percent density. Therefore the particles shrink substantially more than does the preform in which they are carried, and therefore the particles fall out of the preform leaving the desired cavity array in the preform ID.

A conventional Stinger missile warhead is formed in stages: titanium powder is cold isostatically formed into a warhead preform which is then sintered, hot isostatically pressed, and machined to final dimensions. This process is modified in practice of the present invention.

BRIEF DESCRIPTION OF THE DRAWINGS

These and other features and advantages of the present invention will be more fully understood by reference to the following detailed description in conjunction with the attached drawing in which like reference numerals refer to like elements and in which.

DETAILED DESCRIPTION OF PREFERRED EMBODIMENTS

Figure 1:
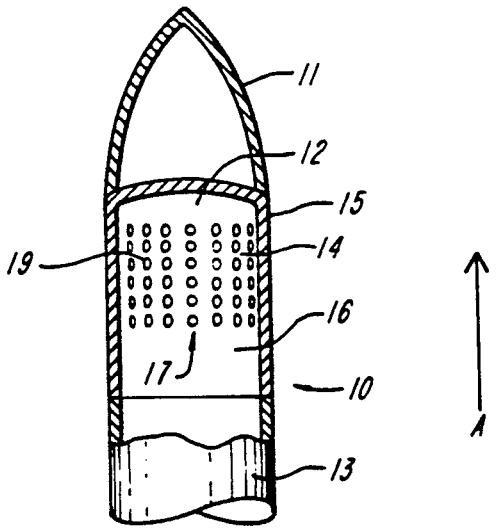
FIG. 1 is a partial side view of a missile incorporating the invention.
Figure 2:
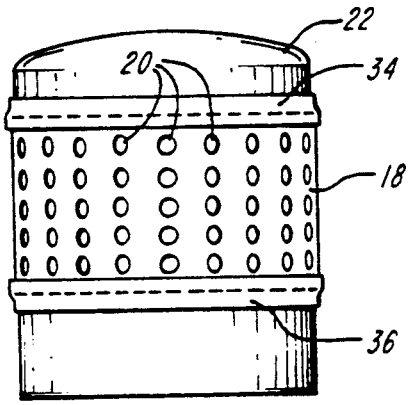
FIG. 2 is a side view of a mandrel with glue mask applied thereto, in practice of the invention.
Figure 3:
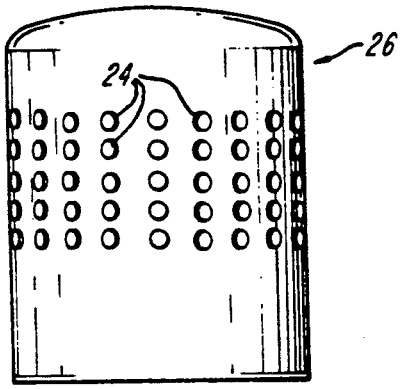
FIG. 3 is a side view of a mandrel with a glue spot array, in practice of the invention.

A Stinger missile is partially shown in the cross-section of FIG. 1, having a nosecone 11 attached to a warhead 10, which in turn is mounted on the missile body 13. The body includes guidance and propulsion systems. An explosive charge is loaded within the interior 15 of the warhead. Preferably equipment is included which controls warhead detonation as the missile comes adjacent to the target.

Warhead 10 has three integral sections: a cap section 12, a center section 14, and a mounting section 16 for mounting of the warhead to the missile body. When the explosive charge is detonated, the cap section is blown outward generally along the longitudinal missile travel axis A. The center section is essentially returned to powder form as it is exploded, and quite likely ignites into a high-intensity heat source. But in practice of the present invention, the center section is further provided with an array 17 of cavities 19. Before loading the warhead on the missile, these cavities are loaded with armament, such as explosive pellets and/or high-density particles. The explosive pellets generate a severe secondary explosion following warhead detonation, and the high-density particles form high-density shrapnel. The warhead is thus more effective in direct and proximity target impacts.

In formation of the cavity-bearing missile body, a missile body preform is isostatically formed from powder material along with low-density ceramic inclusions, the latter being removed during later processing to form the array of cavities. In one aspect of the invention, an array 17 of cavities 19 is formed on the interior 15 of a warhead preform in a method which relies upon differential material densification.

Figure 5:
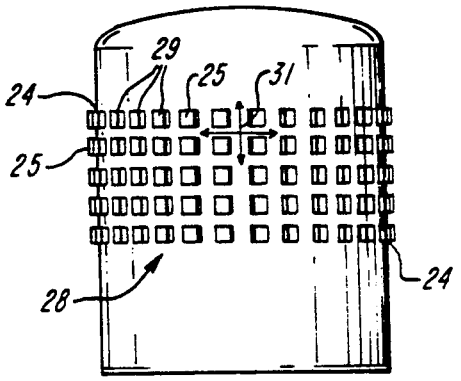
FIG. 5 is a side view of a mandrel with an array of low-density particulate material applied thereto, in practice of the invention.

In this method, a grid pattern of glue is applied to a mandrel 22 via a perforated glue mask 18. The glue is applied through the mask perforations 20 to form a glue grid 26 of glue spots 24 on the mandrel. This grid expresses the desired ordered array 17 of cavities 19. The mask is removed and an array of low-density ceramic particles 28, shown in FIG. 5, is now formed with the particles 29 applied by hand or other suitable method to glue spots 24. Particles 29 are separated by fairly uniform spacing 31.

Figure 6:
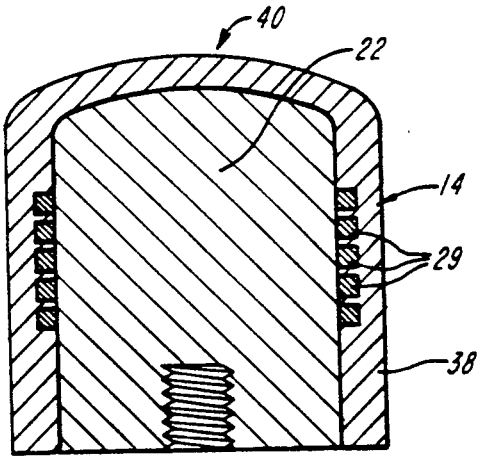
FIG. 6 is a side cross-sectional view of an improved warhead preform formed on a mandrel, in practice of the invention.

The mandrel 22 with the glued-on array 28 of particles 29 is loaded and sealed along with a powder charge 38 in a processing bag, all of which is submitted to cold isostatic pressing within a pressure vessel. By means of this processing, the low-density ceramic particles 29 are compacted along with the included powder charge 38 to form a missile preform 40, with particles 29 anchored in the interior of the preform in the warhead center section 14, while the distal end of each of the particles remains glued to mandrel 22, as seen in FIG. 6.

The compacted assembly is removed from the processing bag as a unit and is heated to about 200 degrees centigrade for about 30 minutes, which expands the warhead preform and softens the glue and permits separation of the glued distal ends of the Particles from the mandrel. The mandrel is now removed from the formed warhead preform, such as by means of the vice/slide-hammer arrangement disclosed in co-pending application Ser. No. 07/669,055, filed Mar. 14, 1991.

Next, the warhead preform is sintered to promote diffusion bonding of the material of the warhead up to about 95 percent density, and then the preform is hot isostatically processed to near full density, and is machined to final dimensions. However, the sintering also densifies the low-density inclusions to about 90 percent density. Since the unsintered preform is formed from powder isostatically compacted to about 75–80 percent density while the low-density inclusions are at about 40–60 percent density, the inclusions experience a higher percentage densification, and thus appear to shrink away from the compacted material of the preform. The low-density inclusions therefore can be removed from, or fall out of, the preform, leaving a circumferential array of cavities on the interior of the preform.

Figure 4:
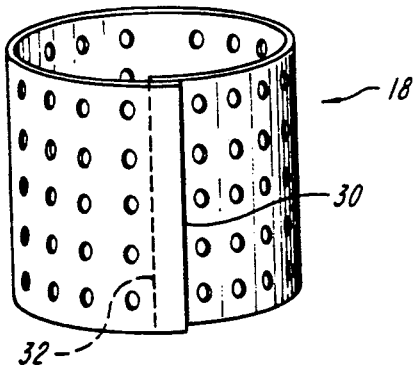
FIG. 4 is a perspective view of a glue mask, in practice of the invention.

In a particular embodiment of the invention, glue mask 18 is formed from a perforated brass sheet, 0.030 inches thick, rolled so that two of its ends 30, 32 meet and can be spot-welded to form a cylinder, shown in FIG. 4, having an ID which will permit it to closely fit over the mandrel OD. The mandrel OD is selected relative to the ID of the warhead preform sought to be formed. Preferably the glue is slow drying, such as STATE GENERIC type, available as GOODYEAR Pliobond Nybco spray glue, which is sprayed over the mask.

In one embodiment, the cavities are generally configured as hollow rectangular voids whose longer dimensions are aligned radially to the central axis of the warhead body. Generally, the cavity spacing in the ordered array ranges from about ½ to 1½ times the average cavity width, with about 20–200 cavities formed in this manner.

Figure 7:
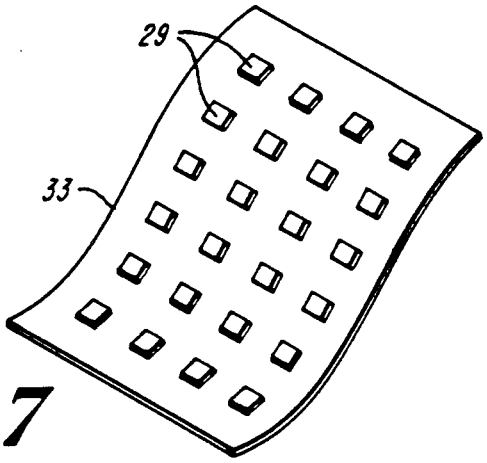
FIG. 7 is a plan view of a mounting strip bearing an array of low-density ceramic particles affixed thereto, in practice of the invention.

FIG. 7 is a plan view of a mounting strip bearing an array of low-density ceramic particles affixed thereto, in practice of an alternative embodiment of the invention. Here the low-density ceramic particles 29 are applied to a band of material 33, such as a Mylar strip for example, via a glue grid previously applied to the mylar or via glue first applied to the individual particles. Once compacted, the mandrel is removed, the mylar is removed, the preform is sintered and then the ceramic particles are removed.

It will be understood that the above description pertains to only several embodiments of the present invention. That is, the description is provided by way of illustration and not by way of limitation. The invention, therefore, is to be limited according to the following claims.

What is claimed is:

1. A compaction method for forming an improved missile warhead having a plurality of armament-receiving cavities defined on the ID thereof, the method comprising the steps of:

(a) loading into an isostatic processing bag a combination of a mandrel with ceramic particles located at selected sites on the mandrel surface and a moderate density particulate material, wherein said ceramic particles have been pre-densified to a first density and wherein the particulate material encompasses the ceramic particle bearing surface of the mandrel, and (b) sealing the bag and submitting the bag to a pressurized fluid environment until the loaded particulate material is compacted to form a missile warhead preform, said preform comprising the compacted particulate material and ceramic particles, and (c) sintering the preform such that the ceramic particles densify to a second density and particulate material densifies to a third density such that the shrinkage of the ceramic particles from the sintering is greater than the shrinkage of the particulate material from the sintering, whereby the difference in the shrinkage of the ceramic particles and the particulate material from the sintering densification causes the ceramic particles to separate from the particulate material, this separation forming cavities on the ID of the preform after the ceramic particles have been removed from the preform.

2. The method of claim 1 wherein the moderate density material is titanium powder.

3. The method of claim 1 wherein the ceramic particles comprise low-density ceramic mixtures selected from the group consisting of zirconia, alumina, and yttria, with a binder.

4. The method of claim 1 wherein the warhead is formed having a cap section integral with a center section, the center section having the cavities formed in an ordered array on the ID of the warhead center section.

5. The method of claim 1 wherein the step of loading a combination includes adhering the supply comprised of low-density ceramic particles to the mandrel periphery before loading the mandrel into the bag.

6. The method of claim 5 wherein the adhering includes placing glue over a portion of the mandrel OD.

7. The method of claim 5 wherein the adhering includes placing a glue mask over the mandrel and forming a glue spot pattern thereon, and applying the particles to the glue spots.

8. The method of claim 7 wherein a grid pattern of glue is applied to the mandrel and then the low-density particles are applied to the mandrel.

9. The method of claim 1 wherein the compaction comprises a cold isostatic pressing process.

10. The method of claim 1 wherein the supply of ceramic particles is affixed to a band and is applied about the circumference of the mandrel.

11. The method of claim 1, further comprising the step of isostatically pressing and machining the preform to final dimensions after the ceramic particles are removed from the preform.

12. The method of claim 2 wherein the titanium is compacted to about 75–80 percent theoretical density before sintering.

13. The method of claim 12 wherein the titanium is sintered to about 95 percent theoretical density.

14. The method of claim 1 wherein the ceramic particles are at about 40–60 percent theoretical density when applied to the mandrel.

15. The method of claim 13 wherein the ceramic particles are sintered to about 90 percent theoretical density.

16. The method of claim 1 wherein the distal ends of the ceramic particles are adhered to the mandrel by application of glue thereto and the sintering is preceded by preheating the compacted contents of the processing bag until the distal ends of the ceramic particles separate from the mandrel and the mandrel is removed.

17. The method of claim 16 wherein the preheating is to about 100 degrees–200 degrees centigrade for about 30 minutes.

18. The method of claim 1 wherein the ceramic particles are adhered to the mandrel by placing a glue mask over the mandrel and forming a glue spot pattern thereon, and applying the ceramic particles to the glue spots.

* * * * *